US006790111B2

(12) United States Patent
Yomo et al.

(10) Patent No.: US 6,790,111 B2
(45) Date of Patent: Sep. 14, 2004

(54) OUTBOARD MOTOR

(75) Inventors: Shigeki Yomo, Iwata (JP); Yoshiyuki Kuramoto, Hamamatsu (JP)

(73) Assignee: Suzuki Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 10/247,513

(22) Filed: Sep. 20, 2002

(65) Prior Publication Data

US 2003/0054709 A1 Mar. 20, 2003

(30) Foreign Application Priority Data

Sep. 20, 2001 (JP) ..... 2001-287226
Sep. 26, 2001 (JP) ..... 2001-294200

(51) Int. Cl.[7] ..... B63H 21/10
(52) U.S. Cl. ..... 440/88 F; 440/77
(58) Field of Search ..... 440/77, 88 R, 440/88 F

(56) References Cited

U.S. PATENT DOCUMENTS 4,098,218 A * 7/1978 Pichl ..... 440/77
4,661,076 A * 4/1987 Iwai ..... 440/77
4,673,360 A * 6/1987 Kojima ..... 440/88 L
4,692,123 A * 9/1987 Tada et al. ..... 440/77
4,708,673 A * 11/1987 Dunham et al. ..... 440/77
5,064,393 A * 11/1991 Inoue ..... 440/77
6,059,619 A * 5/2000 Nozue ..... 440/88 L
6,095,877 A * 8/2000 Kawamukai et al. ..... 440/88 R
6,183,323 B1 * 2/2001 Tanaka et al. ..... 440/77

* cited by examiner

*Primary Examiner*—Andrew Wright
(74) *Attorney, Agent, or Firm*—Oblon, Spivak, McClelland, Maier & Neustadt, P.C.

(57) ABSTRACT

In an outboard motor, a fuel tank is disposed inside an engine cover so as to extend vertically along an axial direction of a crankshaft and arranged in a space in the engine cover in front of the engine on a hull side. The fuel tank is clamped and supported from the vertical direction by a lower engine cover section of the engine cover and an engine starting device disposed above the engine.

11 Claims, 8 Drawing Sheets

OUTBOARD MOTOR

BACKGROUND OF THE INVENTION

The present invention relates an outboard motor provided with an improved fuel tank structure and an improved fuel tank support structure.

In a large or middle sized outboard motor which is equipped to a large-sized boat or like, a fuel tank is generally arranged on the side of a hull of the boat. However, in a small sized outboard motor which is mounted to a small sized boat or like, a fuel tank is often arranged inside an engine cover covering an engine.

Inside the engine cover, the fuel tank is generally arranged such that a mounting seat is provided for the engine or engine cover and the fuel tank is then mounted to the mounting seat through rubber or elastic member by means of bolts or like.

In such arrangement in which the fuel tank is fixed by means of bolts or like, however, when the engine is vibrated by any reason, a boss portion of the fuel tank may be damaged or dismounted from the fixed portion, thus being defective.

Furthermore, the fuel tank fixing method by using such mounting seat and bolt means requires additional parts or elements, which may result in manufacturing cost increasing or deteriorated workability, thus being disadvantageous.

In the meantime, in the case where the fuel tank is arranged inside the engine cover, it is also troublesome and inconvenient to remove the engine cover every time of feeding (pouring) oil, and in order to eliminate such defect, only a fuel pouring port is often disposed outside the engine cover.

In order to arrange the fuel pouring port to a position outside the engine cover, it is necessary to form an opening or hole to the engine cover, which requires to seal such opening so as to prevent sea water or like from entering inside the engine cover through the opening.

In general, however, in a conventional structure, the fuel tank disposed inside the engine cover is formed through a blow-molding process, so that degree of freedom for selection of outer configuration of the fuel tank is severely limited. Accordingly, it is difficult to dispose a bracket or like, for holding a grommet, integrally with the fuel tank and it is hence necessary to additionally arrange another bracket for holding the grommet, which results in an increased number of parts or elements and an increased number of assembling steps, thus increasing manufacturing cost and making assembling steps complicated.

SUMMARY OF THE INVENTION

The present invention was conceived in consideration of the above defects or drawbacks encountered in the prior art mentioned above and an object of the present invention is to provide an outboard motor particularly provided with an improved fuel tank structure capable of fixing the fuel tank without using specific fixing member or element such as bolt and also capable of holding a grommet with an easy construction.

The above and other objects can be achieved according to the present invention by providing an outboard motor which comprises:

an engine having a crankcase in which a crankshaft is perpendicularly arranged;

an engine starting device disposed above the engine in an installed state of an outboard motor;

an engine cover covering the engine and comprising a lower engine cover section fixed and covering a lower portion of the engine and an upper engine cover covering an upper portion of the engine to be detachable;

a drive shaft housing which is disposed below the engine and in which a drive shaft operatively connected to the crankshaft extends perpendicularly;

a gear case disposed below the drive shaft housing; and a fuel tank disposed inside the engine cover so as to extend vertically along an axial direction of the crankshaft, wherein the fuel tank is disposed in a space in the engine cover in front of the engine on a hull side and the fuel tank is clamped and supported from the vertical direction by the lower cover section of the engine cover and the engine starting device.

In a preferred embodiment, the fuel tank is supported by a plurality of tank support bosses provided for peripheral equipments disposed to a periphery of the fuel tank, and a plurality of engagement grooves are formed to surface portions of the fuel tank so as to respectively correspond to and engaged with the engine tank support bosses.

The peripheral equipments include a starter cover of the engine starting device having a front end lower surface to which one of the tank support boss is mounted, and an engine support plate constituting the engine lower cover section and having a front end upper surface to which another one of the tank support bosses is mounted. The plural tank support bosses further include a pair of lateral tank support bosses mounted to a front surface of the crankcase. Thus, the fuel tank is supported at vertical two portions and two portions on the side surface of the fuel tank.

The fuel tank has an outer configuration having a shape along an inside shape of the engine cover.

The engine cover may be formed of synthetic resin.

The fuel tank comprises a tank body mounted to the engine, a fuel pouring member (passage) extending upward from the tank body externally of the engine upper cover section through an insertion hole formed thereto, and a fuel pouring port formed to an extending end of the fuel pouring member.

The insertion hole formed to the engine upper cover section is closed by a grommet from an inside of the engine and a grommet holding flanged member is disposed to the fuel tank. The grommet holding flanged member is fixed to the fuel tank by press-fitting means or fusing means. The grommet holding flanged member has a plate shape and is disposed above the engine starting device and to an intermediate portion of the fuel pouring member directly below the fuel pouring port.

The grommet holding flanged member has size and shape, in a plan view, substantially overlapping with size and shape of the engine starting device.

The functions and advantageous effects attainable by the present invention will be made clear from the following descriptions with reference to the accompanying drawings as well as further characteristic features of the present invention.

DESCRIPTION OF THE PREFERRED EMBODIMENTS

Figure 1:
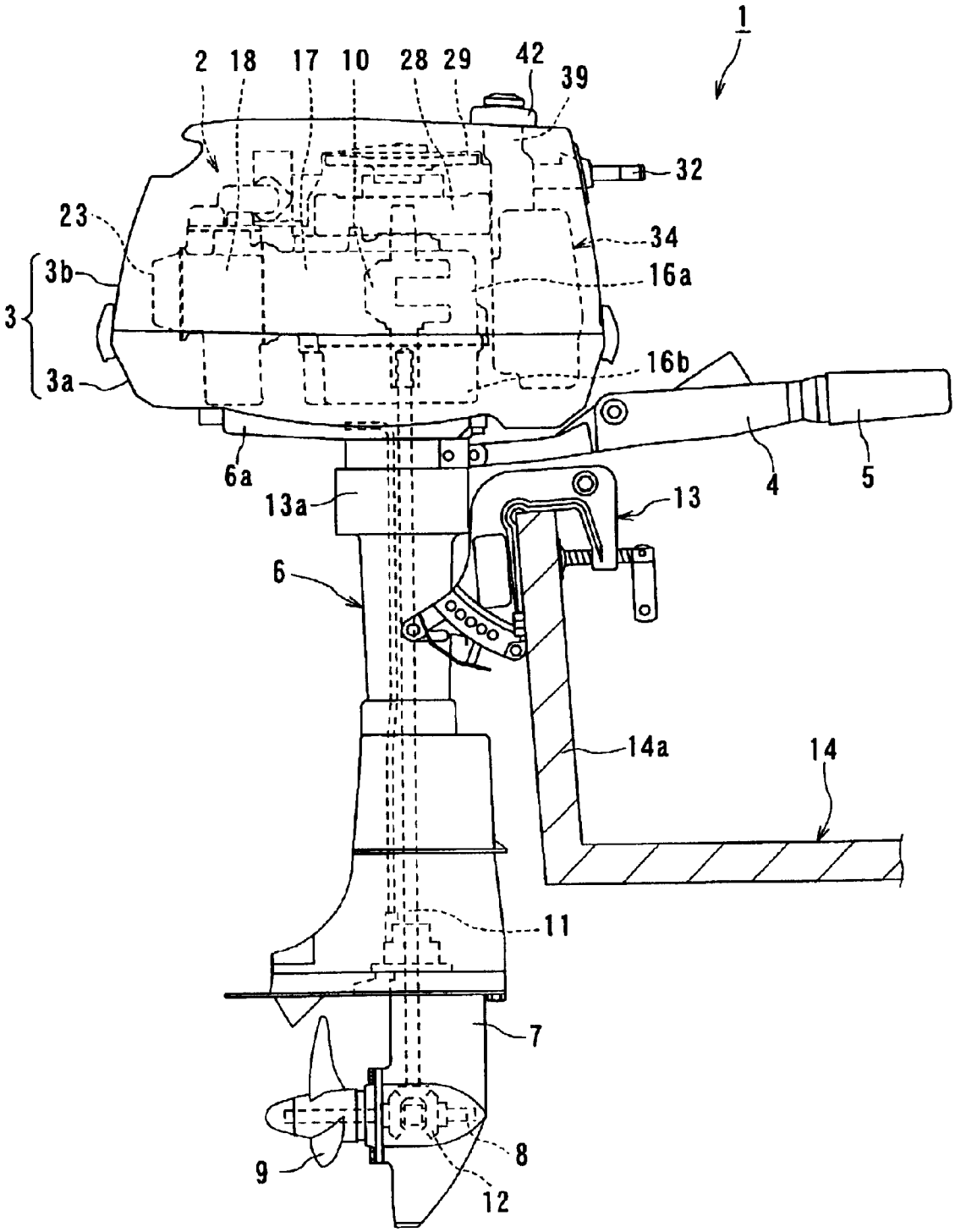
FIG. 1 is a right-side view showing an outboard motor according to one embodiment of the present invention provided with an improved fuel tank structure.

With reference to FIG. 1 showing a right-side view of an outboard motor according to the present invention in an operative state mounted to a hull of a boar or like, an outboard motor 1 is equipped with a vertical type engine 2, which is surrounded by an engine cover 3. A steering handle 4 extends forward (right side as viewed in FIG. 1) from a front lower portion of the engine 2, and a throttle grip 5, for adjusting engine output, is secured to the front end of the steering handle 4.

The engine cover 3 is formed from a synthetic resin, for example, and has a structure splittable into vertical two parts, i.e. a lower cover section 3*a* covering a lower portion of the engine 2 and an upper cover section 3*b* covering an upper portion of the engine, the upper cover section 3*a* being mounted to be detachable.

A drive shaft housing 6 is disposed to the lower portion of the lower cover section 3*a*, and an extension 6*a* is formed integrally with the upper end portion of the drive shaft housing 6. The engine 2 is arranged above the extension 6*a*. A gear case 7 is also arranged to the lower portion of the driveshaft housing 6. Inside the gear case 7, a propeller shaft 8 is journaled and supported and a propeller 9 is secured to the rear end portion of the propeller shaft 8.

Inside the engine 2, a crankshaft 10 is vertically arranged so as to extend perpendicularly therein, and a drive shaft 11 is coupled to the lower end portion of the crankshaft 10 so as to extend downward in the drive shaft housing 6. The lower end of the drive shaft 11 is coupled, through a bevel gear 12, to the propeller shaft 8. An output of the engine 2 is converted into rotational motion of the crankshaft 10, which is then transmitted, through the drive shaft 11 and the bevel gear 12, to the propeller to thereby rotate the same.

An upper portion of the drive shaft 6 is supported, to be rotatable, to a rotation support member 13*a* of a clamp bracket 13, which is secured to a transom 14*a* of a hull 14 of a boat or like. That is, the outboard motor 1 is mounted to the hull 14 to be rotatable (pivotal), and the outboard motor 1 changes its direction by horizontally swinging the steering handle 4 to thereby steer the hull 14.

Figure 2:
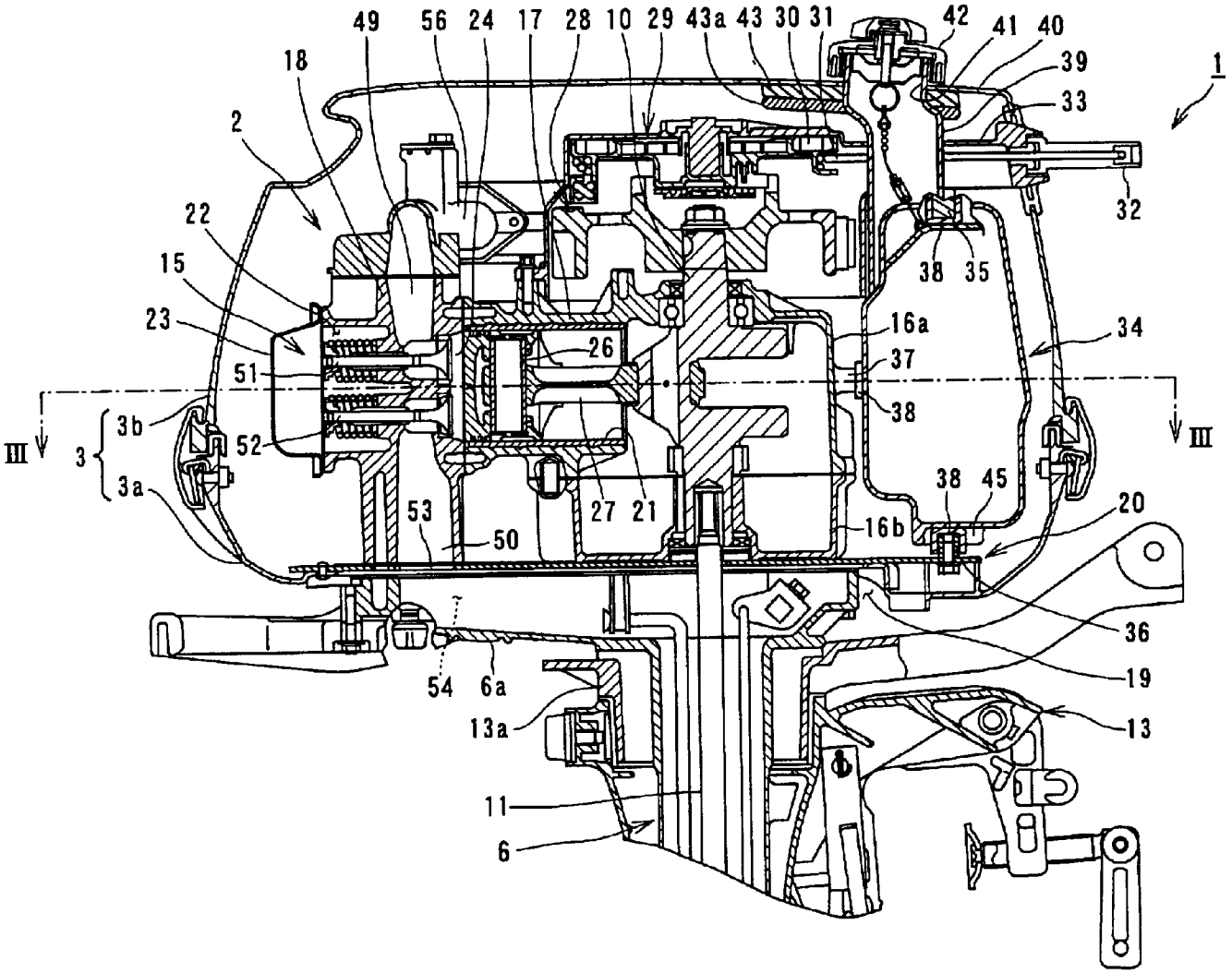
FIG. 2 is an elevational section of an engine of the outboard motor.
Figure 3:
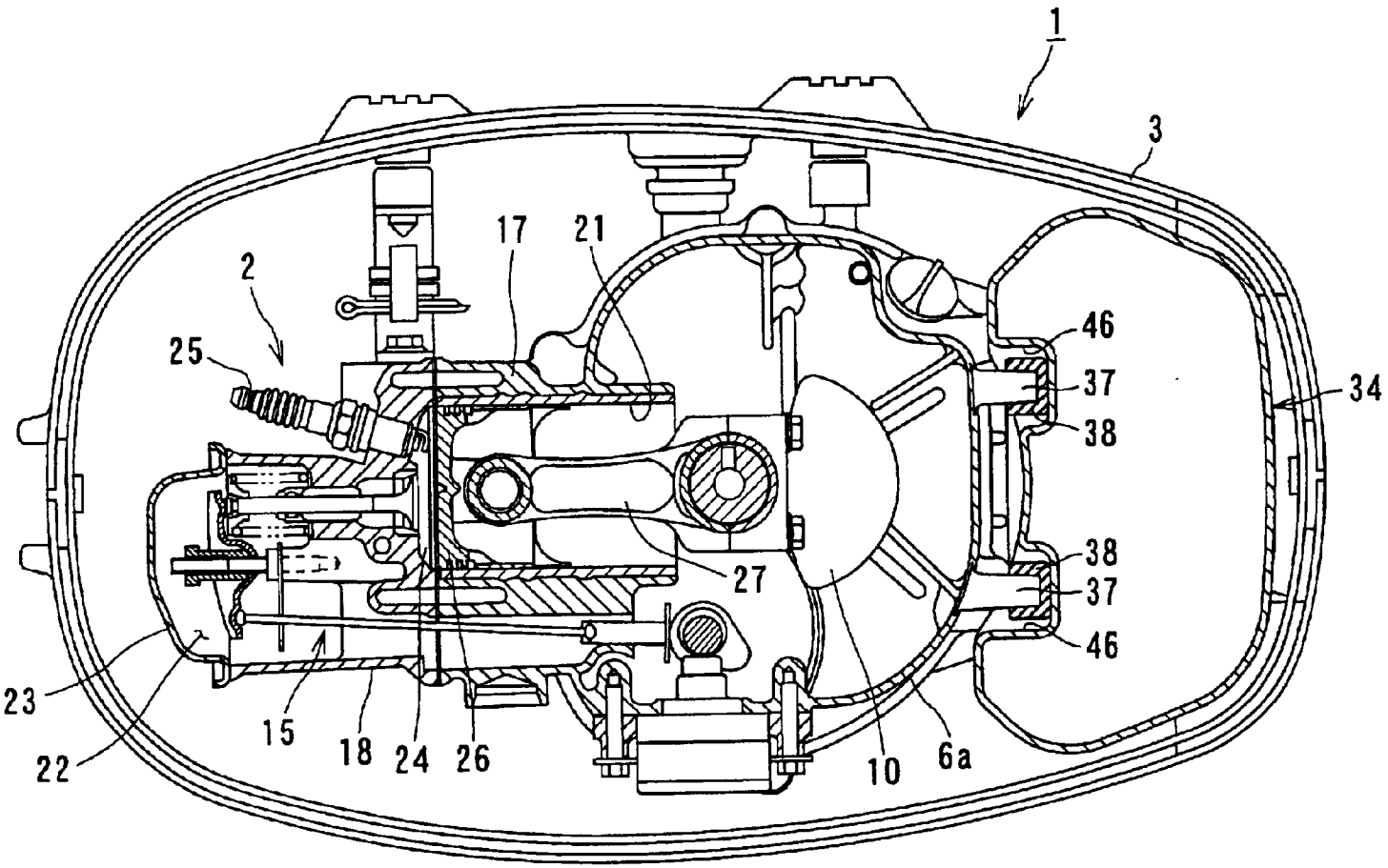
FIG. 3 is a sectional view taken along the line III—III in FIG. 2.

As shown in FIGS. 1, 2 and 3, the engine 2 of this embodiment is a four-stroke-cycle single-cylinder engine provided with, for example, OHV-type valve train mechanism 15. The engine 2 is provided with a crankcase composed of vertical dividable two parts of upper and lower crankcase parts 16*a* and 16*b* disposed on the front side (right side of FIGS. 1 to 3) of the outboard motor 1, a cylinder block 17 disposed behind (left side as viewed in FIGS. 1 to 3) the crankcase parts 16*a* and 16*b* so as to be integral with the upper case part 16*a* of the crankcase, and a cylinder head 18 disposed at the rear side (left side as viewed in FIGS. 1 to 3) of the cylinder block 17.

The lower cover section 3*b* has a bottom central portion to which an opening 19 is formed, and this opening 19 is closed (clogged) from the inside of the lower crankcase part 16*b* by an engine support plate 20. The engine support plate 20 is interposed between the lower surface of the engine 2 (i.e. bottom portion of the lower side crankcase part 16*b* and bottom surface of the cylinder head 18) and the extension 6*a*. In this state, the engine lower surface, the extension upper surface and the engine support plate are clamped and unitarily fastened by means of bolts, for example, not shown.

As shown in FIGS. 2 and 3, the cylinder block 17 is provided with a cylinder 21 extending in a direction perpendicular to the crankshaft 10 (as viewed in a side view) towards the longitudinal direction of the outboard motor 1 (lateral direction in FIG. 2 or 3). The rear portion of the cylinder block 18 is opened, and a valve train chamber 22 for accommodating the valve train mechanism 15 is formed inside the cylinder block 17. The valve train chamber 22 is closed by a cylinder head cover 23. The cylinder head 18 is formed with a combustion chamber 24 aligned with the cylinder 21, and an ignition plug 25 is mounted to the combustion chamber 24 from the outside thereof.

Figure 8:
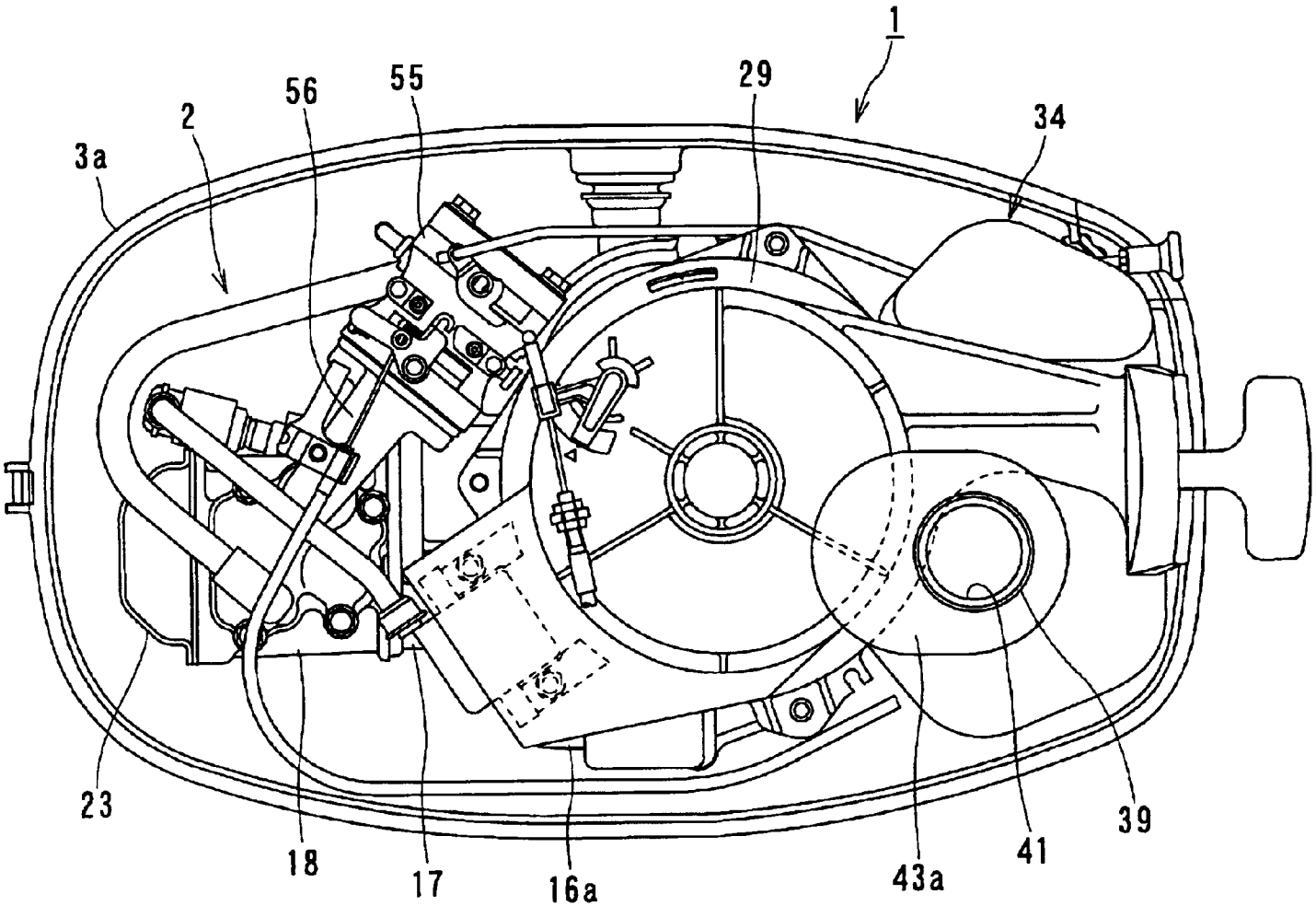
FIG. 8 is a plan view of the engine of FIG. 2.

With reference to FIGS. 2 and 8, in the cylinder head 18, an intake port 49 and an exhaust port 50 are formed so as to communicate with the combustion chamber 24, and in the cylinder head 18, there are also disposed an intake valve 51 and an exhaust valve 52 for opening and closing the intake port 49 and the exhaust port 50, respectively.

The exhaust port 50 extends in the cylinder head 18 downward towards the extension 6*a* of the drive shaft housing 6. The exhaust gas from the exhaust port 50 is exhausted outside the outboard motor 1 through an exhaust hole 53 formed to the support plate 20, an exhaust passage 54 formed in the extension portion 6*a* and the inside of the drive shaft housing 6.

Furthermore, as shown in FIG. 8, a carburetor 55 is arranged to the upper portion of the cylinder block 17 so as to constitute an intake system, and the downstream side of the carburetor 55 is connected to, through an inlet pipe 56, the intake port 49 opened to the upper surface of the cylinder head 18.

A piston 26 is slidably fitted into the cylinder 21, and the piston 26 is coupled to the crankshaft 10 by means of connection rod 27 to thereby convert the reciprocal motion of the piston 26 in the cylinder 21 to rotational motion of the crankshaft 10. Furthermore, a flywheel magnet device 28 for power generation and a rope-recoil type manual engine starting device 29 are disposed to the upper end portion of the crankshaft 10 above the engine 2.

Figure 4:
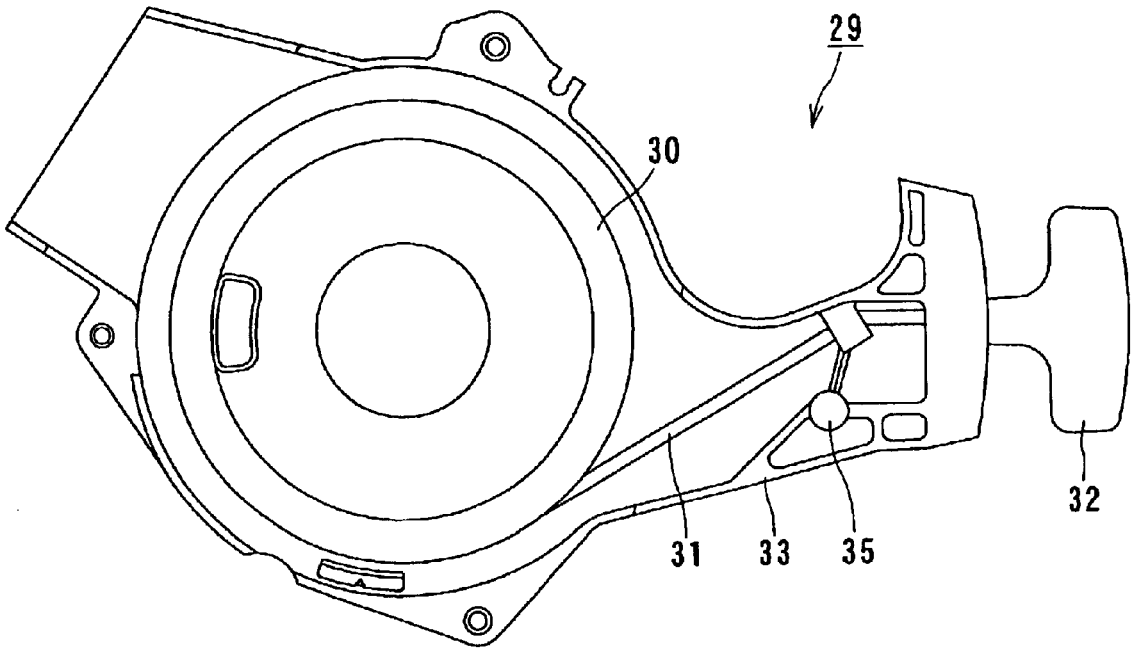
FIG. 4 is a view of an engine starting device viewed from a lower side.

FIG. 4 is a view of the engine starting device 29 viewed from the lower side thereof. With reference to FIGS. 2 and 4, the engine starting device 29 is provided with a starter disc 30, a starter rope 31 having one end tied to the starter disc 30 and wound up therearound, and a starter grip 32 secured to another end of the starter rope 31 and directed forward to the front surface of the upper cover section 3*b* of the engine cover 3. The upper surface and side surface of the engine starting device 29 are covered by a starter cover 33 made of synthetic resin.

A fuel tank 34 made of synthetic resin and formed through a blow-molding process is disposed in a space of the engine cover 3 in front of the engine 2 (right hand portion in FIGS. 1 to 3, i.e. hull side). The fuel tank 34 is arranged so as to extend vertically along the axial direction of the crankshaft 10 in an installed state of the outboard motor to the hull 14, and as shown in FIG. 3, the fuel tank 34 has an outer configuration along the inside shape of the engine cover 3.

As shown in FIG. 2, the fuel tank 34 is positioned and then supported by a plurality of support bosses including: a tank support boss 35 formed to the lower surface of the front end portion of the starter cover 33 of the engine starting device 29 towards the downward direction; a tank support boss 36 secured, so as to direct upward, to the upper surface of the front end portion of the engine support plate 20 secured to the lower cover section 3*a*; and a pair of lateral tank support bosses 37 to the front surface of the upper case part 16*a* of the crankcase so as to integrally project forward. The respective tank support bosses 35, 36 and 37 are covered with elastic materials or members 38 such as mount rubbers 38 or like.

Figure 5:
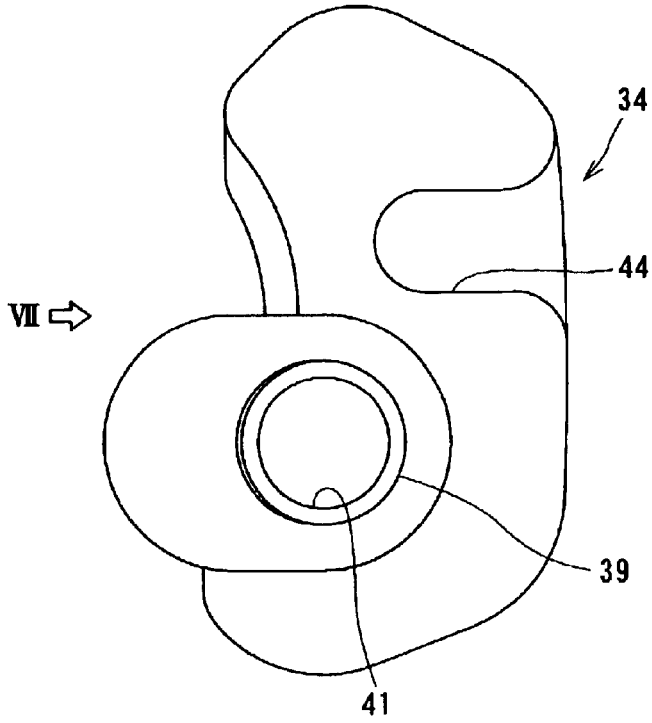
FIG. 5 is a view of a fuel tank of the outboard motor as viewed from an upper surface side.
Figure 6:
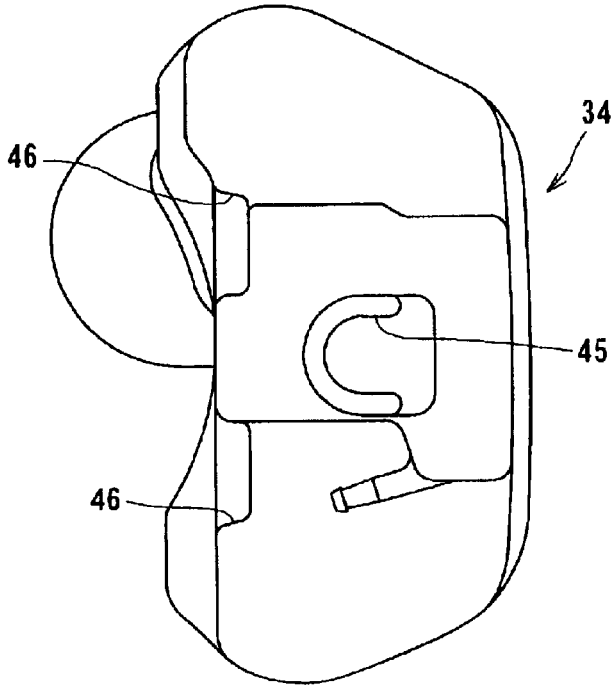
FIG. 6 is a view of the fuel tank as viewed from a lower surface side.
Figure 7:
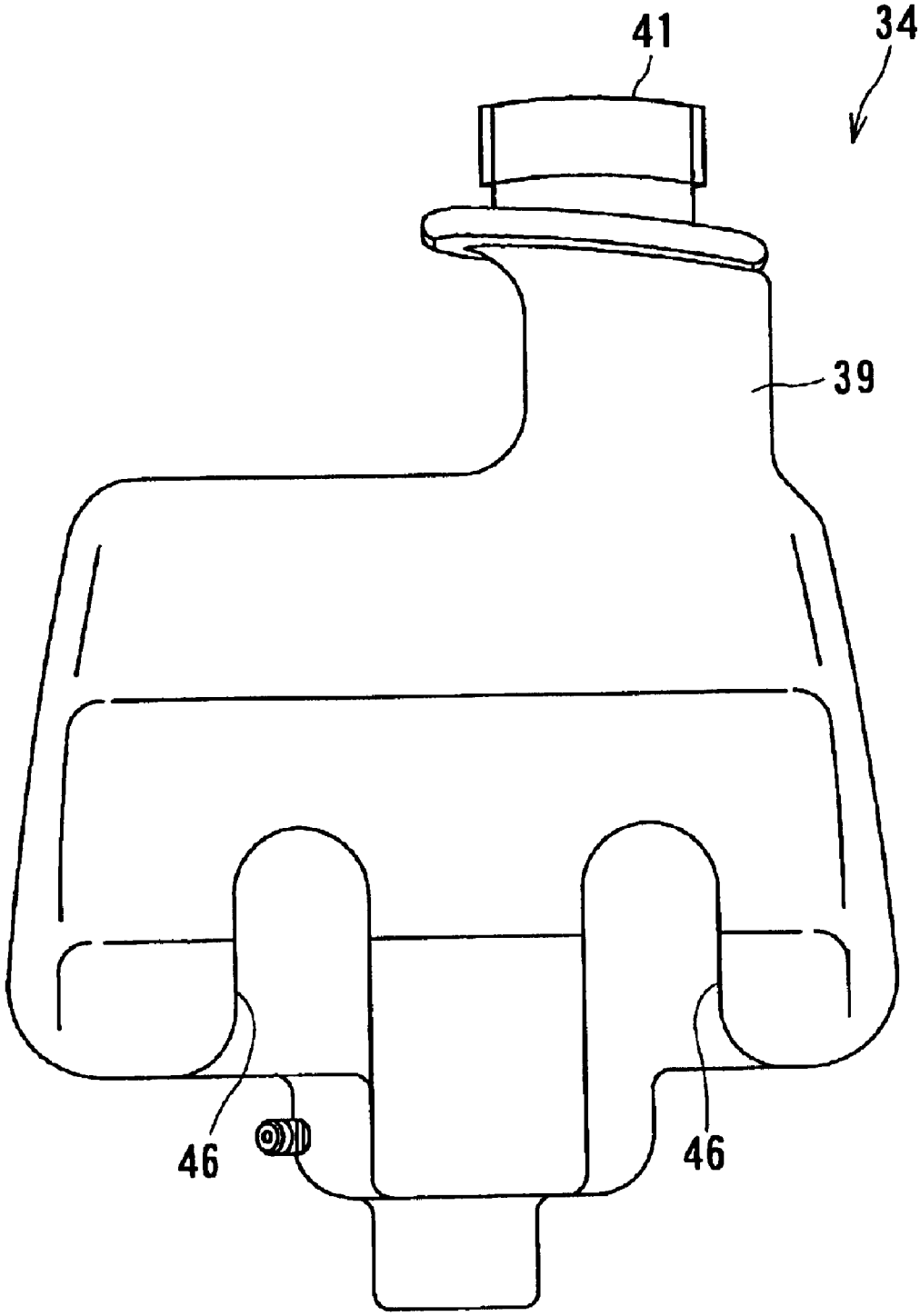
FIG. 7 is a rear (side) view of the fuel tank as viewed from a direction of arrow VII in FIG. 5.

FIGS. 5 and 6 are illustrations viewed from upper and lower sides of the fuel tank 34, respectively, and FIG. 7 is an illustration showing a rear side surface of the fuel tank 34, being viewed from an arrow direction VII in FIG. 5.

With reference to FIGS. 5 to 7 in addition to FIGS. 2 and 3, the fuel tank 34 is provided with a tank body, a fuel pouring member (passage portion) 39 integrally formed with the fuel tank body and extending upward from the upper surface thereof and projecting externally above the upper engine cover section 3*b* through a fuel pouring member insertion hole 40 formed to the upper cover section 3*b*. A fuel pouring port 41 is formed to a projected end portion and is closed by a fuel cap 42. The fuel pouring member insertion hole 40 is closed by a grommet 43 formed of, for example, foamed rubber from the inside of the upper cover section 3*b* to thereby establish a sealing to prevent sea water or like foreign material from entering inside the engine cover 3.

To the upper surface of the fuel tank 34,there is formed an engagement groove 44, so as to be opened forward (rightward as viewed in FIG. 5), with which the tank support boss 35 provided to the front lower surface of the starter cover 33 of the engine starting device 29 is engaged.

Furthermore, to the central portion of the lower surface of the fuel tank 34, there is formed an engagement groove 45, so as to be opened forward (rightward as viewed in FIG. 6), with which the tank support boss 36 provided to the front upper surface of the engine support plate 20 of the engine lower cover section 3*a* is engaged.

There is also formed, to the rear surface of the fuel tank 34, a pair of lateral engagement grooves 46, so as to be opened downward, with which a pair of lateral tank support bosses 37 provided to the front surface of the upper portion of the crankcase are engaged.

The fuel tank 34 is disposed in a space in front of the engine 2 inside the engine cover 3 (i.e. hull side), and the engine starting device 29 is then mounted from the upper side. In this mounting, the tank support boss 36 of the engine support plate 20 is engaged with the engagement groove 45 formed to the lower surface of the fuel tank 34 and, also, the tank support boss 35 provided to the front end lower surface of the starter cover 33 is engaged with the engagement groove 44, respectively, to thereby clamp and support the fuel tank 34 at its upper and lower portions, thus positioning the fuel tank 34 in its vertical attitude.

In addition, the tank support bosses 37 provided to the front surface of the upper case part 16*a* of the crankcase is engaged with the engagement groove 36 to thereby position and support the fuel tank 34 in its horizontal attitude.

Figure 9:
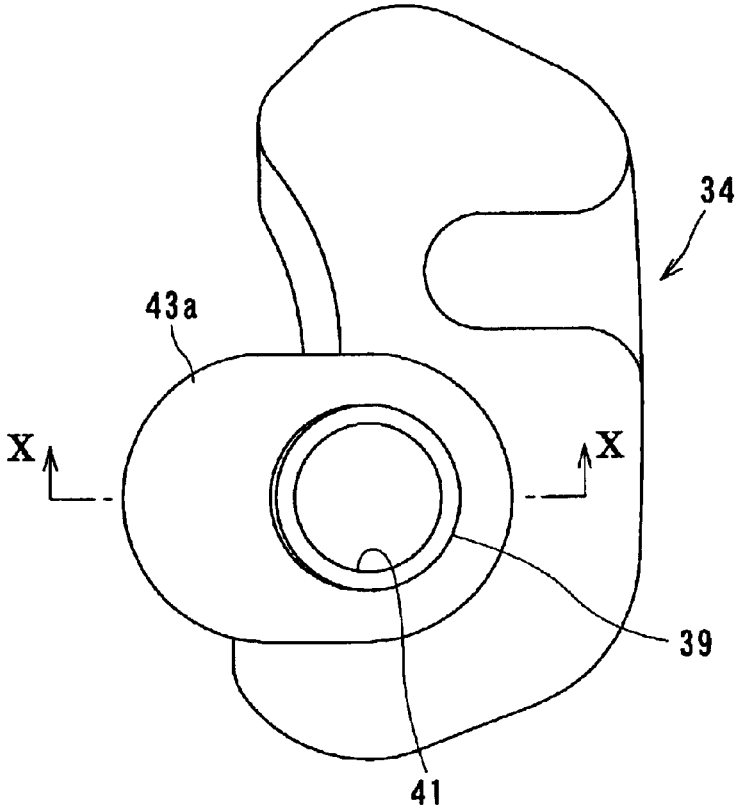
FIG. 9 is a plan view, similar to FIG. 5, showing a grommet holding flange for the fuel tank of the outboard motor.
Figure 10:
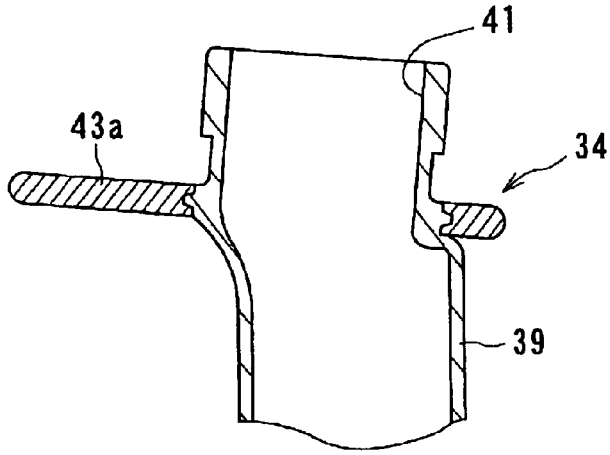
FIG. 10 is a sectional view taken along the line X—X in FIG. 9 showing the grommet holding flange mounted to a fuel pouring member.

Further, with reference to FIGS. 9 and 10, a grommet holding flange 43*a* of flat plate shape is formed to the middle portion of the fuel pouring member (passage) 39 extending upward from the fuel tank 34 and directly below the fuel pouring port 41.

This grommet holding flange 43*a* is disposed, as shown in FIG. 2, above the engine starting device 29, to a position at which the grommet 43 is closely contacted to the fuel pouring member insertion hole 40. The grommet holding flange 43*a* has a plane size approximately overlapping to the engine starting device 29 (FIG. 8), and this flange 43*a* is secured to the fuel pouring member 39 by press-fitting means or fusing means.

Operation of the present invention of the structure mentioned above will be made clear from the following descriptions, as well as function and advantageous effects of the present invention.

The fuel tank 34 is disposed in a space in front of the engine 2 inside the engine cover 3, and the fuel tank 34 is clamped and supported therein from the upper and lower sides by the lower cover section 3*a* below the fuel tank 34 and the engine starting device 29 above the fuel tank 34. According to this structure, it is not necessary to use a fuel tank mounting seat, a fuel tank fastening bolt or like member. As a result, the number of parts or members to be used for fastening can be extremely eliminated and the assembling working can be made simple.

Furthermore, the tank support bosses 35, 36 and 37 are provided for the equipments or members surrounding the fuel tank 34, that is, in this embodiment, front end lower surface of the starter cover 33 of the engine starting device 29, front end upper surface of the engine support plate 20 and the front surface of the upper side portion 16 of the crankcase constituting the engine component. The surfaces of the fuel tank 34 corresponding to the arrangement of these bosses 35, 36 and 37 are formed with the engagement grooves 44, 45 and 46 to be engaged with these bosses 35, 36 and 37 to thereby surely position and support the fuel tank 34. Moreover, in order to reduce the transferring of vibration or like of the engine 2 to the fuel tank 34, the elastic mounts such as mount rubbers 38 are applied to these bosses 35, 36 and 37.

Still furthermore, the fuel tank 34 can be surely supported at at least vertical two portions and side (lateral) two portions.

In addition, since the fuel tank 34 is formed with the configuration along the inside shape of the engine cover 3, the inner capacity of the fuel tank 34 can be effectively utilized.

Furthermore, according to the structure in which the grommet holding flange 43*a* of the flat plate shape is secured to the fuel pouring member 39 formed to the fuel tank 34 by a press-fitting method or a fusing method, the number of the parts or members to be assembled is reduced and the grommet 43 can be surely held with the simple assembling working.

Moreover, the grommet holding flange 43*a* is disposed above the engine starting device 29 to a position at which the grommet 43 is closely contacted to the fuel pouring member insertion hole 40 so as to have a size in a plan view approximately overlapping with the engine starting device 29, so that the fuel tank 34 can be disposed in the space in front of the engine 2 inside the engine cover 3 by minimally reducing the increasing in dimension of the engine 2. This location of the fuel tank 34 makes it possible to pour the fuel from the hull side.

Further, it is to be noted that the present invention is not limited to the described embodiments and many other changes and modifications may be made without departing from the scopes of the appended claims.

For example, in the described embodiment, the present invention is mainly described with reference to the fuel tank, but it may be possible that the present invention will be applicable to an oil tank storing lubricant of an outboard motor mounted with two-stroke-cycle engine.

What is claimed is:

1. An outboard motor comprising:

an engine having a crankcase in which a crankshaft is perpendicularly arranged;

an engine starting device disposed above the engine in an installed state of an outboard motor;

an engine cover covering the engine and comprising a lower engine cover section fixed and covering a lower portion of the engine and an upper engine cover section covering an upper portion of the engine to be detachable;

a drive shaft housing which is disposed below the engine and in which a drive shaft operatively connected to the crankshaft extends perpendicularly;

a gear case disposed below the drive shaft housing; and a fuel tank disposed inside the engine cover so as to extend vertically along an axial direction of the crankshaft, said fuel tank is disposed in a space in the engine cover in front of the engine on a hull side and being clamped and supported from the vertical direction by the lower cover section of the engine cover and the engine starting device by means of a plurality of tank support bosses provided for peripheral equipments disposed to a periphery of the fuel tank, said tank support bosses being engaged with a plurality of engagement grooves formed in a surface of the fuel tank.

2. An outboard motor according to claim 1, wherein said peripheral equipments include a starter cover of the engine starting device having a front end lower surface to which one of said tank support bosses is mounted, and an engine support plate constituting the engine lower cover section and having a front end upper surface to which another one of said tank support bosses is mounted.

3. An outboard motor according to claim 2, wherein said fuel tank support bosses further include a pair of lateral tank support bosses mounted to a front surface of the crankcase.

4. An outboard motor according to claim 3, wherein said fuel tank is supported at vertical two portions and two portions on a side surface thereof.

5. An outboard motor according to claim 1, wherein said fuel tank has an outer configuration having a shape along an inside shape of the engine cover.

6. An outboard motor according to claim 1, wherein said engine cover is formed of synthetic resin.

7. An outboard motor according to claim 1, wherein said fuel tank comprises a tank body mounted to the engine, a fuel pouring member extending upward from the tank body externally of the engine upper cover section through an insertion hole formed thereto, and a fuel pouring port formed to an extending end of the fuel pouring member.

8. An outboard motor according to claim 7, wherein said fuel pouring member insertion hole formed to the engine upper cover section is closed by a grommet from an inside of the engine and a grommet holding flanged member is disposed to the fuel tank.

9. An outboard motor according to claim 8, wherein said grommet holding flanged member is fixed to the fuel tank by at least one of press-fitting means and fusing means.

10. An outboard motor according to claim 9, wherein said grommet holding flanged member has a plate shape and is disposed above the engine starting device and to an intermediate portion of the fuel pouring member directly below the fuel pouring port.

11. An outboard motor according to claim 10, wherein said grommet holding flanged member has size and shape, in a plan view, substantially overlapping with size and shape of the engine starting device.

* * * * *